US005542348A

United States Patent [19]

Bendzick

[11] Patent Number: 5,542,348

[45] Date of Patent: Aug. 6, 1996

[54] PROCESS FOR COMPACTING METAL SHAVINGS

[76] Inventor: Ervin J. Bendzick, R. R. No. 1, Box 307A, New Prague, Minn. 56071

[21] Appl. No.: 373,027

[22] Filed: Jan. 17, 1995

Related U.S. Application Data

[62] Division of Ser. No. 74,946, Jun. 10, 1993, Pat. No. 5,391, 069.

[51] Int. Cl.[6] ..... B30B 9/04; B30B 11/02

[52] U.S. Cl. ..... 100/37; 100/249; 100/269.05; 100/906; 264/86; 264/120

[58] Field of Search ..... 100/37, 48, 50, 100/104, 110, 116, 125, 126, 130, 131, 215, 249, 269.05, 269.14, 903, 906; 264/86, 120; 425/78, 84, 86, 147, 149, 150, 412, 419, 420

[56] References Cited

U.S. PATENT DOCUMENTS

| | | | |
|---|---|---|---|
| 1,822,939 | 9/1931 | Stout | 425/78 |
| 2,067,401 | 1/1937 | Lassman | 425/149 |
| 2,110,972 | 3/1938 | Dinzl | 100/906 |
| 2,359,674 | 10/1944 | Pollock | 425/420 |
| 2,697,979 | 12/1954 | MacMurray | 100/906 |
| 2,892,397 | 6/1959 | Finkelstein | 100/100 |
| 3,168,033 | 2/1965 | Hansen | 100/116 |
| 3,179,998 | 4/1965 | Lamb | 425/419 |
| 3,183,570 | 5/1965 | Vogt | 264/86 |
| 3,434,392 | 3/1969 | Landers | 100/249 |
| 3,618,707 | 12/1971 | Sluhan | 184/109 |
| 3,651,755 | 3/1972 | Gati | 100/215 |
| 3,980,014 | 9/1976 | McEwen et al. | 100/906 |
| 4,232,600 | 11/1980 | LeJeune | 100/37 |
| 4,303,412 | 12/1981 | Baikoff | 100/37 |
| 4,346,653 | 8/1982 | Rodak | 100/37 |
| 4,373,889 | 2/1983 | Brown | 425/150 |
| 4,389,928 | 6/1983 | Burgin | 100/37 |
| 4,483,248 | 11/1984 | Ostreng | 100/125 |
| 4,557,190 | 12/1985 | Vezzani | 100/249 |
| 4,771,686 | 9/1988 | Triantos, Jr. | 100/255 |
| 4,927,085 | 5/1990 | Oberg | 241/36 |
| 5,039,294 | 8/1991 | Gautier et al. | 425/420 |
| 5,125,331 | 6/1992 | Wood | 100/37 |
| 5,188,848 | 2/1993 | Taddei | 425/419 |

FOREIGN PATENT DOCUMENTS

| | | | |
|---|---|---|---|
| 505688 | 5/1971 | Switzerland | 100/249 |
| 2088331 | 6/1982 | United Kingdom | 425/147 |

*Primary Examiner*—Stephen F. Gerrity
*Attorney, Agent, or Firm*—Kinney & Lange, P.A.

[57] ABSTRACT

A metal shavings and chips compactor for extruding oil from metal chips and shavings and compacting the metal into easily transportable pellets. A compactor cylinder contains a piston and has an opening through which an auger feeds metal chips and shavings. A gate closes an end of the cylinder. A first hydraulic drive drives the piston under low pressure to close the opening and apply a first compacting pressure on the metal to form a loosely compacted pellet in the cylinder. High pressure then operates the piston to form a compact metal pellet substantially void of interstices. A second hydraulic drive opens the gate; the piston is operated at low pressure to discharge the compact metal pellet from the chamber and oil is collected below the cylinder. The compacting pressures are achieved through mechanical advantages provided by the size of the piston to that of the first hydraulic drive. A microprocessor controls operation of the compactor, and sensors detect the completion of the several operations to operate the microprocessor to control the hydraulic system and the thickness of the pellet produced.

4 Claims, 3 Drawing Sheets

TO SIDE HOPPER
μ PROCESSOR
Hp
Lp
M
S

PROCESS FOR COMPACTING METAL SHAVINGS

This is a divisional of application Ser. No. 08/074,946, filed Jun. 10, 1993 (now U.S. Pat. No. 5,391,069).

BACKGROUND OF THE INVENTION

This invention relates to apparatus for compacting metal shavings, chips and the like into easily-transportable pellets. More particularly, the invention compacts metal shavings to remove cutting fluids, such as oil from the shavings, and to compact the shavings into pellets so that the cutting fluid and the metal shavings may be separately recycled.

In metal working shops, metal shavings, chips or the like result from hot-working the metal during fabrication of pans. Examples of hot-working metal include cutting and grinding and other processes where the metal is cut to shape the metal. It has been the practice in most shops to collect the shavings, chips and the like, and send them to a foundry for recycling. The cutting, grinding or other hot-working process usually requires the use of cutting fluid, such as cutting oils, to disperse heat from the part being produced during the hot-working process. Excess cutting fluid is collected, cleaned and recycled, often directly back to the machine tool performing the hot-working process. Excess oil on the parts produced may be collected by drip-drying or other processes to again return the cutting fluid to be cleaned and recycled. However, it has not been practical to collect cutting fluid from the metal shavings. Instead, most machine shops have simply collected the metal shavings for pickup by the foundry where the shavings are subjected to high temperature to burn off the oil and reduce the shavings to a usable metal.

Currently, foundries accept oil-laden waste metal for recycling. However, environmental concerns require firing oil-soaked metal shavings in specially constructed furnaces which prevent hydrocarbon discharge. Hence, the cost of recycling such oil-laden shavings is high. Moreover, interstices formed by the shavings decreases the over-all density of the metal, thereby increasing transportation costs.

While compactors exist for compacting organic waste for ease of transportation and other uses (including manufacturing organic pellets for fuel), there is no effective, economic compactor for compacting metal shavings, chips and the like to extrude cutting oil therefrom and to compact the meal into pellets suitable for transportation. More particularly, while organic compactors operate at pressures of about 1,000 to 1,500 pounds per square inch (psi), and some as high as 6,000 psi, at least 20,000 psi pressure is necessary to compact meal shavings, chips and the like. Moreover, compactors of organic material usually include drain ports from the compaction chamber to permit fluids to be extruded for collection. While the drain ports operate quite satisfactory for organic wastes at the low pressure of compaction (1,000 to 1,500 psi), drain ports would not be practical at the high pressure required for metal shavings compaction, because the high pressure would force meal into the drain thereby impairing the operation of the device.

The present invention is directed to a compactor for compacting metal shavings to a condensed pellet, absent of interstices and of significant amounts of cutting fluid. Using the present invention, cutting fluid is forced from the interstices of the metal shavings under pressure and collected for cleaning and recycling. The shavings are compacted into a compressed pellet suitable for easy handling and transportation.

As an example of the savings to the machine working shop employing the present invention, foundries currently pay about $20.00 per ton for oil-laden meal shavings for processing by the foundry to reclaim the metal. In contrast, foundries currently pay about $60.00 per ton for the pellets formed using the present invention, primarily because the pellets do not require processing to remove the oil and are easier to handle. Moreover, the present invention permits the metal working shop to recover additional cutting fluids for use within the shop.

SUMMARY OF THE INVENTION

A compactor is provided for compacting metal chips, shavings and the like. The compactor includes a compactor stage having a compactor cylinder containing a piston and having an opening through which feed means, such as an auger, feeds metal chips, shavings and the like into the compactor cylinder. An opposite end is normally closed by a gate which is movable to permit metal pellets to be discharged. A first drive means, comprising a hydraulic cylinder, moves the piston in the compactor cylinder, the hydraulic cylinder being selectively operated under low pressure to operate the piston to close the opening and apply a first compacting pressure on the metal chips, shavings and the like in the chamber. Thereafter, high pressure operates the hydraulic cylinder to operate the piston to apply a second compacting pressure on the loosely compacted pellet in the chamber as to form a compact metal pellet substantially devoid or free of interstices. Thereafter, second drive means, comprising a second hydraulic cylinder, opens the gate and the hydraulic cylinder is operated at low pressure to move the piston to discharge the compact metal pellet from the chamber.

The high pressures are achieved through a mechanical advantage between the drive mechanism for the compactor and the compactor piston itself and by employing a two stage pressure operation onto the compacting piston. The mechanical advantage provides an adequate first compacting pressure to extrude cutting oil from the metal shavings, chips and the like and form a loosely compacted pellet, and an adequate second compacting pressure to further extrude oil from the loosely compacted pellet and to compact the loosely compacted pellet to form a compact metal pellet substantially devoid of interstices.

Extrusion of fluids is accomplished by sizing the space or tolerance between the gate and compactor cylinder walls to permit the fluids to be extruded or expelled under high pressure without displacing metal which would otherwise block a drain.

Preferably, a microprocessor controls operation of the compactor. Sensors detect the completion of the several operations to operate the microprocessor to control the hydraulic system operating the drives. Additional sensors detect the position of the piston upon completion of the high pressure compacting pressure to adjust time of operation of the feed auger to thereby adjust the thickness of further metal pellets.

DETAILED DESCRIPTION OF THE PREFERRED EMBODIMENTS

Figure 1:
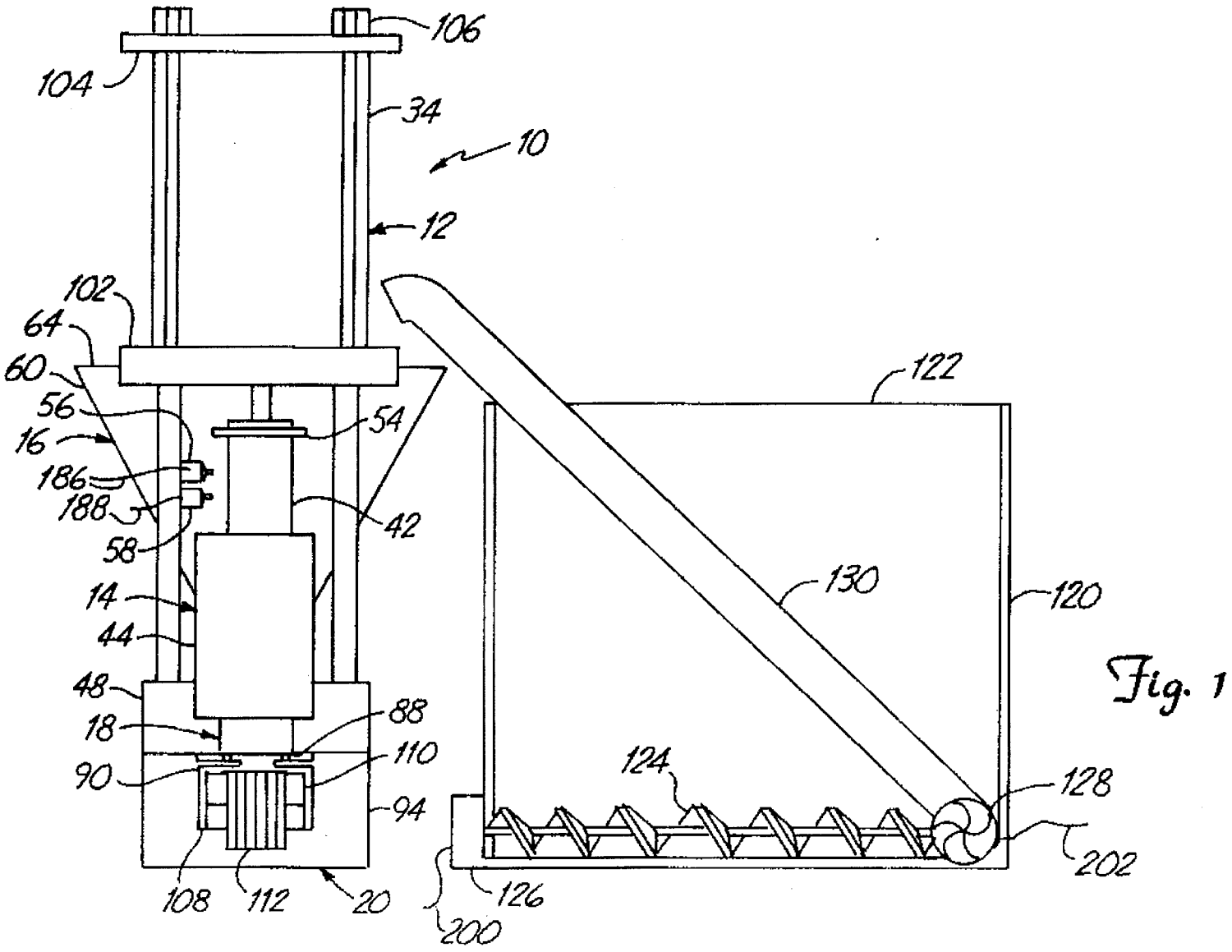
FIG. 1 is a frontal view of a compactor in accordance with the presently preferred embodiment of the present invention, the compactor being shown with an optional feeder hopper to one side.
Figure 2:
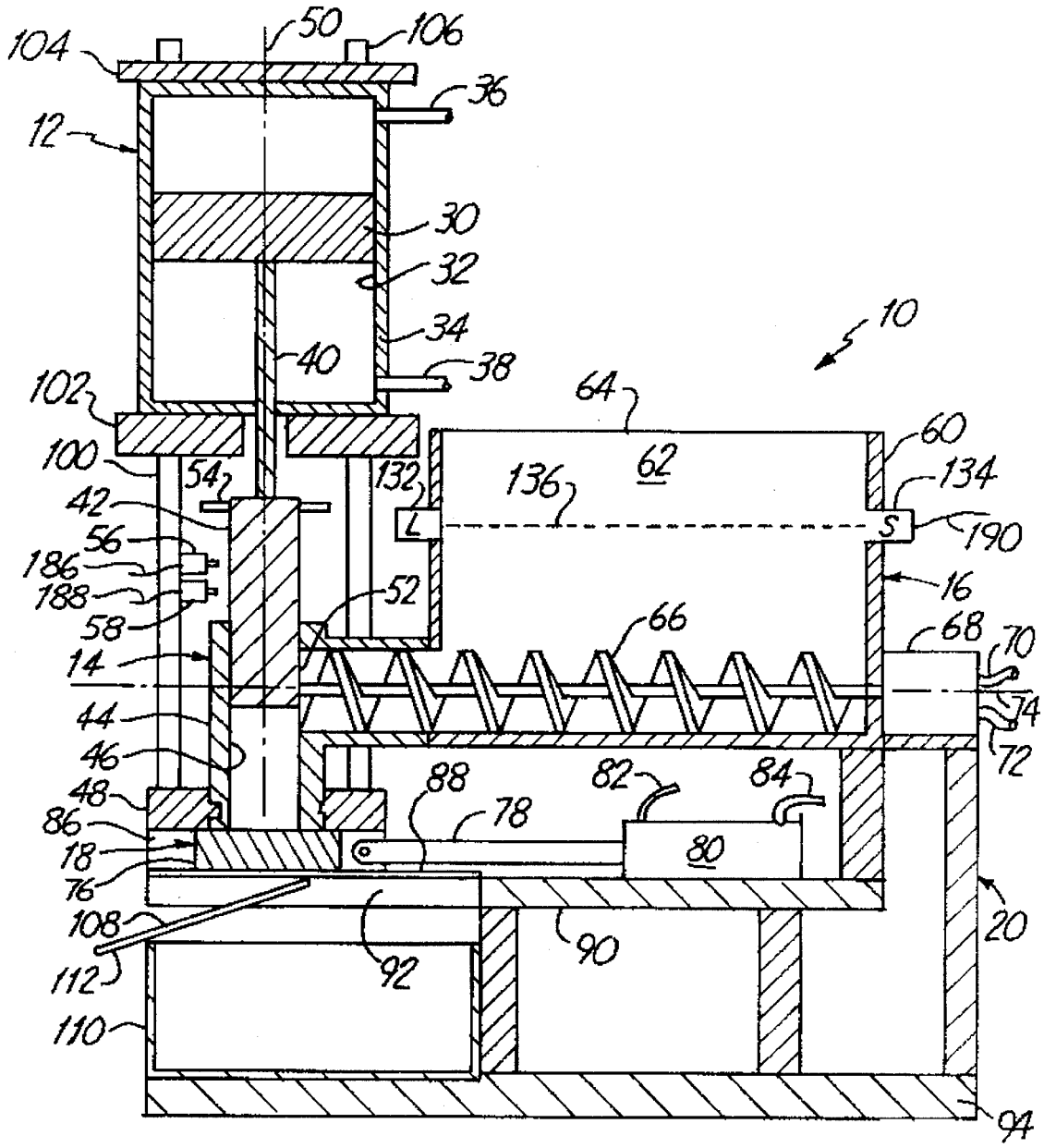
FIG. 2 is a section view of the compactor taken at line 2—2 in FIG. 1.

Referring to FIGS. 1 and 2, there is illustrated a compactor 10 for compacting metal chips and shavings in accordance with the presently preferred embodiment of the present invention. The principal features of compactor 10 comprise a first drive mechanism 12, a compactor stage 14, feed mechanism 16 and discharge stage 18, all mounted on frame 20.

Drive mechanism 12 comprises a hydraulically operated piston 30 disposed within hydraulic cylinder 32 formed by housing 34. Hydraulic conduits 36 and 38, connected to housing 34 on opposite sides of piston 30, are connected to a hydraulic system (shown in FIG. 3). Drive shaft 40 is directly connected to piston 30, and is in turn directly connected to piston 42 of compactor stage 14.

Compactor stage 14 includes housing 44 forming compactor chamber or cylinder 46 therein. Housing 44 is mounted to member 48, which is part of the frame, and is axially aligned on axis 50 with the axis of piston 30, drive shaft 40 and piston 42. Housing 44 includes opening 52 to feed mechanism 16. Collar 54 is mounted to piston 42 and is arranged to operate switches 56 and 58 for purposes to be explained hereinafter.

Feed mechanism 16 includes housing 60 forming a hopper 62 which is open at the top 64. As shown particularly in FIG. 1, the walls of housing 60 are at an angle and arranged to feed material downwardly to auger 66 (FIG. 2). Auger 66 is operated by hydraulic motor 68 to drive metal shavings and chips through opening 52 and into chamber or cylinder 46. Motor 68 is connected by hydraulic conduits 70 and 72 to the hydraulic system illustrated in FIG. 3. Preferably, the axis 74 of auger 66 is arranged normal or perpendicular to axis 50 of housing 44.

The discharge stage 18 includes a solid gate member 76 mounted to reciprocating member 78 which in turn is operated by a piston within drive mechanism 80. Drive mechanism 80 is a hydraulically operated piston within a cylindrical housing, operated through hydraulic conduits 82 and 84 connected to the hydraulic system illustrated in FIG. 3. Drive mechanism 80 is operable to reciprocate gate member 76 between a first position shown in FIG. 2 and a retracted position to the right thereof. Gate member 76 slides against surfaces 86 of member 48, and on rails 88 which are part of frame member 90. Frame member 90 includes an opening 92 directly below housing 44 to permit discharge of compacted metal shavings and chips, as well as cutting fluid.

The frame 20 may be of any suitable construction to support the other pans, and includes a base 94, member 48 and member 90. The frame supports housing 44 of the compactor stage, feed mechanism 16 and discharge stage 18. Supports 100 are mounted to member 48 to support member 102 which in turn supports housing 34. Conveniently, supports 100 may extend upwardly, outside of housing 34, to clamp member 104 thereon. Thus, the clamping members 102 and 104 aid in supporting pressure within cylinder 32. Fasteners 106 fasten to the top of supports 100 to sandwich housing 34 between members 102 and 104. Conveniently, frame 20 includes an opening 108 into which hopper 110 may rest on frame 94. A grated ramp 112 is positioned at the upper portion thereof, ramp 112 being formed of a grate or rail mechanism to permit cutting fluid to be collected in hopper 110. Ramp 112 is disposed at an angle to permit compacted pellets discharged from cylinder 46 to be collected in a bin (not shown).

Optionally, a side hopper with automatic feed may be provided to introduce metal chips and shavings into housing 60. This side hopper is shown in section in FIG. 1 and includes a housing 120 having an opening 122 into which metal chips and shavings are deposited. Housing 120 is preferably quite large compared to housing 60, and may be rectangular in shape. One or more augers 124 are located at the bottom of housing 120 and are operated by motor 126. Motor 126 is a hydraulic motor, like motor 68, with electric controls for purposes to be explained hereinafter. Auger(s) 124 feeds metal chips and shavings to grinder 128 which grinds large metal shavings into smaller shavings or chips. More particularly, in thread-cutting operations, the metal shaving formed by the thread-cutting tool may be quite long, representing the length of several convolutions of thread. For example, a shaving from a thread cut in a two inch diameter pipe having 16 convolutions of thread will produce a shaving of about 100 inches in length. It is desirable to grind these lengthy shavings into smaller lengths, (of the order of about two inches) to facilitate transport by elevator 130. Moreover, the shorter length to such shavings reduces any cutting action of piston 42 at opening 52 when the piston closes that opening. The outlet of grinder 128 is connected to elevator 130 which includes an auger screw to lift the shavings to hopper 60.

If the side-hopper mechanism shown in FIG. 1 is employed, it is preferred that housing 60 be incorporated with an electric eye in the form of an incandescent lamp 132 and radiant sensor 134. Lamp 132 is operable to shine light via path 136 onto sensor 134 for purposes to be explained.

Figure 3:
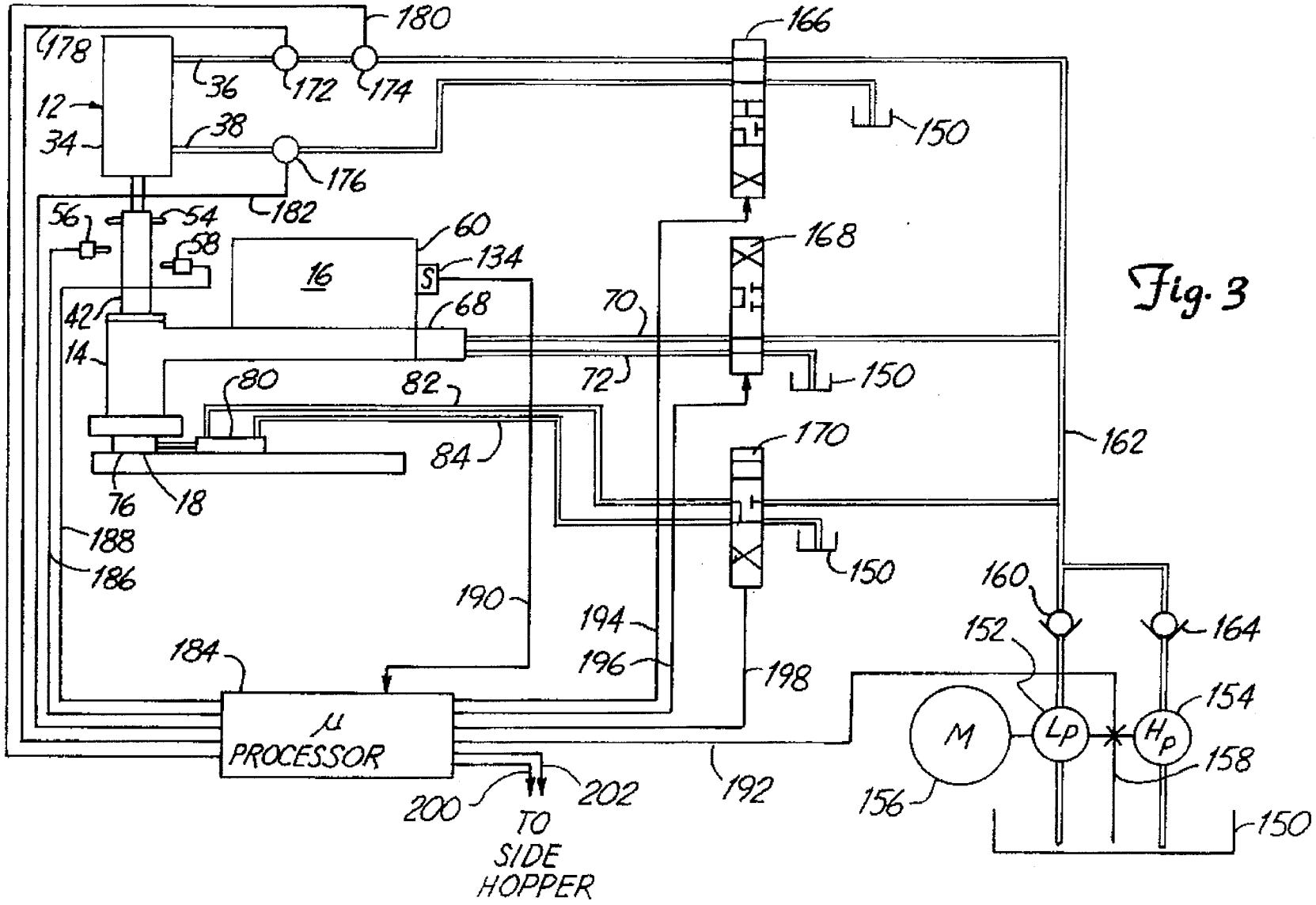
FIG. 3 is a diagram of the hydraulic and electric controls for the compactor illustrated in FIGS. 1 and 2.

FIG. 3 illustrates the electric and hydraulic systems for controlling the compactor according to the present invention. The hydraulic system includes a reservoir 150 providing an inlet to low-pressure pump 152 and high-pressure pump 154. Motor 56 operates pumps 152 and 154, and electrically operated coupler 158 is operated to selectively divert high-pressure fluid to reservoir 150. The output of low-pressure pump 152 is connected through check valve 160 to a main hydraulic conduit 162. Similarly, the outlet of high-pressure pump 154 is connected through check valve 164 to conduit 162. As will be more fully understood hereinafter, low-pressure pump 152 is operable to pump fluids into conduit 162 below about 1,500 psi, whereas high-pressure pump 154, when operated, operates to increase the pressure within conduit 162 to a range within about 3,000 to 5,000 psi. Check valve 160 is operable to permit fluid to be pumped by low-pressure pump 152 into conduit 164 when the pressure within conduit 164 is below the design level of check valve 160, about 1,500 psi, and prevents fluid from flowing back into pump 152 from conduit 162 when the pressure in conduit 162 is higher than the design level of check valve 160. Check valve 164 performs the same function as check valve 162, but at a significantly higher pressure.

Hydraulic valves 166, 168 and 170 are connected to conduit 162. Each valve 166, 168 and 170 has three positions. In a first position of valve 166, conduit 162 is connected directly to conduit 36 of drive mechanism 12, and conduit 38 of drive mechanism 12 is connected directly to reservoir 150. Hydraulic switches 172 and 174 in conduits 36 and hydraulic switch 176 in conduit 38 provide electrical signals for purposes to be explained hereinafter. As diagrammatically illustrated in connection with valve 166, the valve has a second position in which conduit 38 is connected to conduit 162 and conduit 36 is connected to reservoir 150, and a neutral position in which conduits 36 and 38 are connected together and to reservoir 150, and conduit 162 is blocked. Additionally, valve 166 has in intermediate position where conduit 36, 38 and 162 are connected together and to reservoir 150 for purposes to be explained.

Valve 168 operates motor 68 and has a first position in which conduit 70 is connected directly to conduit 162 and conduit 72 is connected to reservoir 150. Valve 168 has a second position in which the relationship of the conduits is reversed so that conduit 70 is connected to reservoir 150 and conduit 72 is connected to conduit 162. A third or neutral position of valve 168 connects conduits 70 and 72 together, and conduit 162 is blocked.

Valve 170 is also a three-position valve having a first position connecting conduit 82 of drive mechanism 80 to conduit 162 and connecting conduit 84 to reservoir 150. In a second position of valve 170, conduit 82 is connected to reservoir 150 and conduit 84 is connected to conduit 162. In a third position, conduits 82 and 84 are connected together and to reservoir 150, and conduit 162 is blocked.

Switches 172, 174 and 176 provide electrical output signals via signal channels 178, 180 and 182, respectively, to microprocessor 184. Switches 56 and 58 provide output signals via signal channels 186 and 188, respectively, to microprocessor 184 and sensor 134 provides an output signal via signal channel 190 to microprocessor 184. Microprocessor 184 provides output signals via signal channel 192 to operate coupling 158 and via signal channels 194, 196 and 198 to operate hydraulic valves 166, 168 and 170, respectively.

If the hopper 120 illustrated in FIG. 1 is employed, microprocessor 184 also provides output signals via signal channels 200 and 202 to motor 126 and grinder 128 of the hopper.

In operation of the apparatus illustrated in the drawings, hopper 62 is filled with metal shavings and chips. Pistons 30 and 42 are in a retracted or upper position so that opening 52 provides easy passage of metal chips and shavings from bin 62 to the chamber formed in cylinder 46. Initially, gate 76 is in the position illustrated in FIG. 2 closing the end of cylinder 46. Microprocessor 184 operates coupler 158 via signal channel 192 to disconnect high-pressure pump 154 from motor 156. Also, microprocessor 184 operates valve 166 to its neutral position so that conduits 36 and 38 are connected together, and operates valve 170 to its neutral position, thereby closing conduits 82 and 84. Microprocessor 184 also operates valve 168 to a position connecting conduit 70 to conduit 62 and connecting conduit 72 to the reservoir 150. With the apparatus in the condition thus described, low-pressure pump 152 is operated to provide low-pressure hydraulic fluid to motor 68 to operate the motor in a first direction to rotate auger 66 and to transport metal shavings and chips from bin 62 into the chamber formed by cylinder 46.

After a predetermined period of time determined by the microprocessor, usually about seven seconds, microprocessor 184 operates valve 168 to its neutral position, connecting conduits 70 and 72 together, thereby halting operation of motor 68 and auger 66. Conduits 70 and 72 are connected together to avoid bleeding the conduits and to permit the conduits to be ready for operation during the next portion of the cycle. Microprocessor 184 operates valve 166 to a first position illustrated in FIG. 3 thereby connecting conduit 36 to conduit 162 and connecting conduit 38 to reservoir 150. As previously described, low-pressure pump 152 provides hydraulic fluid into conduit 162 at low pressure, about 1,500 psi. The pressure differential across piston 30 within cylinder 32 causes piston 30 to begin moving downwardly (as illustrated in FIG. 2) thereby carrying piston 42 downwardly to close off opening 52. At the same time, metal shavings and chips within cylinder 46 begin to become compacted within the cylinder between piston 42 and the upper surface of gate 76, as piston 42 travels downwardly. Metal does not compress. Instead, the metal shavings and chips compact, thereby forcing cutting fluid out of the interstices formed between the metal shavings and chips. Hence, oil is forced out toward the cylinder walls.

When piston 42 has compacted the metal in cylinder 46 to the degree it can be compacted with the low-pressure pump, the pressure within housing 34 reaches the low pressure limit (1,500 psi). Switch 172 detects the low pressure limit and provides a signal via channel 178 to microprocessor 184 to indicate the completion of the low-pressure cycle. At this point in the cycle, the compactor apparatus has formed a loosely compacted pellet from the metal chips and shavings in the chamber, the loosely compacted pellet having substantial interstices therein. Microprocessor responds to the signal from switch 172 to operate coupler 158 via signal channel 192 to operate high-pressure pump 154. High-pressure pump 154 supplies high pressure hydraulic fluid to conduit 162, thereby introducing high-pressure hydraulic fluid into cylinder 32. In this case, the high-pressure hydraulic fluid is of the order of 3,000 to 5,000 psi. Fluid does not return to the reservoir through a reversal of low-pressure pump 152 due to check valve 160. Low-pressure pump 152 may continue to operate during the period of operation of high-pressure pump, although it does not contribute to the pressure of the fluid in conduit 162.

During the operation of high-pressure pump 154, the metal shavings and chips within the chamber of cylinder 146 are further compacted thereby extruding any remaining cutting fluid from the interstices of the compacted metal and forming a metal pellet substantially devoid of interstices.

I have found that the pressure imposed on the metal chips and shavings should be at least about 20,000 psi to adequately compact the chips and shavings into a solid pellet substantially absent of interstices. Such pressures are necessary to make the pellet suitable for transportation without crumbling. I achieve this pressure through a mechanical advantage between the pistons of cylinder 32 and 46. More particularly, it can be shown that the pressure $p_1$ within cylinder 46 is represented by $$p_1 = p_2 \frac{r_2^2}{r_1^2}$$

where $P_2$ is the pressure within cylinder 32, $r_2$ is the radius of piston 30 and $r_1$ is the radius of piston 42. I achieve a minimum 20,000 psi in cylinder 46 by employing a drive mechanism wherein piston 30 has a diameter of about 10 inches and piston 42 has a diameter of about 3.5 inches. These characteristics of the pistons provide a mechanical advantage of about 8.33, so that for a hydraulic fluid pressure of 3,000 psi within the drive mechanism 12, I am able to achieve a pressure of nearly 25,000 psi within the compactor stage 14. Pressures of about 42,000 psi can be achieved within chamber 46 with a pressure of about 5,000 psi in cylinder 52.

A second feature of the present invention centers on frame member 90 supporting gate 76 with a spacing to permit expelling oil, yet holding metal in the chamber. More particularly, I have found that with a 0.020 inch tolerance between gate 76 and the walls of cylinder 46 and member 48, the cutting fluid collected at the walls of the piston and on the gate are expelled through the close tolerance of the piston and the cylinder wall, so that the fluid passes gate 76 and through the space between rails 88 into hopper 110 for collection. While it is unlikely cutting fluid will be extruded through the top of the cylinder, primarily because fluid would more likely pass through opening 52 and into hopper 62, an optional shroud (not shown) may be employed above the cylinder to direct cutting fluid back to the hopper 110.

Operation of the high-pressure portion of the compaction cycle is for a very short period of time, about two seconds, as controlled by the microprocessor. When the pressure reaches the designed level, namely 3,000 psi in hydraulic conduit 36, switch 174 operates to provide a signal indicating drive mechanisms 12 has reached its high-pressure limit (e.g. 3,000 psi), indicative that the pressure in cylinder 46 is about 25,000 psi. Microprocessor 184 reacts to the signal to disconnect connector 158, thereby diverting oil from high-pressure pump 154 to the reservoir. Also, microprocessor 184 reacts to that signal to operate valve 166 to its intermediate position to momentarily connect conduits 36, 38 and 162 together and to reservoir 150 to bleed conduit 162. Valve 166 continues to move to its neutral position to connect conduit 36 and 38 together and to-reservoir 150 to relieve any pressure differential across piston 30 and to block conduit 162. Additionally, microprocessor 184 operates valve 170 to connect conduit 82 to conduit 162 and to connect conduit 84 to reservoir 150. Drive mechanism 80 is operated under fluid pressure to retract gate 76, thereby opening the bottom of cylinder 46. After sufficient time has elapsed permitting drive mechanism 80 to open gate 76, microprocessor 84 operates valve 170 to its neutral position, thereby connecting conduits 82 and 84 to reservoir 150, and operates valve 166 to connect conduit 36 to conduit 162 and to connect conduit 38 to reservoir 150. Since conduit 162 is now at low pressure (1,500 psi), low-pressure hydraulic fluid is supplied to the chamber of drive mechanism 12, thereby forcing piston 42 downwardly to eject the metal pellet within cylinder 46.

Switch 176 operates when piston 30 reaches its lowest level, a position in which the pellet formed in cylinder 46 has been fully discharged. Switch 176 provides a signal to the microprocessor to cause the microprocessor to reset the controls to permit the operation to be repeated. In this respect, valve 170 is operated to connect conduit 84 to conduit 162 and to connect conduit 82 to reservoir 150, thereby moving the gate back to the position shown in FIG. 2 closing chamber 46, valve 166 is operated to connect conduit 38 to conduit 162 and to connect conduit 36 to reservoir 150, thereby withdrawing the piston to its upper position, and valve 168 is operated to connect conduit 70 to conduit 162 and connect conduit 172 to reservoir 150 to operate motor 68. Thus, another quantity of chips and shavings are introduced to the chamber formed in cylinder 46 and the process repeats.

For convenience, valve 168 includes a reverse position where the connection of conduits 68 and 70 to conduit 162 and reservoir 150 are reversed to permit driving motor 68 in reverse. This valve position may be used, for example, to reverse auger 66 to clear any debris from the auger.

As heretofore described, microprocessor 184 operates motor 68 for a predetermined period of time to introduce shavings and chips into cylinder 46. The length of time, usually less than about four seconds, during which microprocessor 184 operates motor 68 is determined by the operation of switches 56 and 58 operated by collar 54. More particularly, if a relatively small volume of chips and shavings are introduced into cylinder 46 from hopper 62, the compaction cycle will form a smaller or thinner pellet, than may be desired. Conversely, if too much material is introduced to cylinder 46, the pellet will be larger or thicker than may be desired. Switches 56 and 58, cooperating with collar 54, provide signals to the microprocessor defining the range of travel of piston 42 within cylinder 46, and hence the thickness of the resulting pellet. More particularly, if too much material is introduced into cylinder 46 during a given cycle, the compaction of the chips and shavings within cylinder 46 is such that piston 42 will not travel far enough for collar 54 to operate switch 56. Hence, the absence of the signal from switch 56 indicates to the microprocessor that a large quantity of material is being supplied to the cylinder during each cycle. Microprocessor 184 responds to the absence of a signal from switch 56 to shorten the time period of operation of auger 66 and reduce the amount of material fed into the cylinder. Conversely, if a small quantity of material is supplied to cylinder 46, the travel of piston 42 will be such that collar 54 will operate both switches 56 and 58, thereby advising the microprocessor that the time period for operating auger 66 should be lengthened to permit more material to be introduced for each pellet. Hence, switches 56 and 58 serve to control the thickness of the pellets produced by the compactor within a desired range, such that the desired thickness of pellets is achieved when switch 56 is operated and switch 58 is not operated.

One feature, associated with the optional side hopper, resides in the use of the electric eye consisting of lamp 132 and sensor 134. When the level of chips and shavings within hopper 62 is reduced to a level that sensor detects light from lamp 132 via path 136, a signal is provided by sensor 134 to microprocessor 184 to provide control signals to hopper 120 via signal channels 200 and 202. More particularly, hopper 120 is operated by the microprocessor to move chips and shavings into grinder 128 and to operate grinder 128 to grind the chips and shavings into a desirable length and move them along the auger within elevator 130 to hopper 62. Thus, in addition to automatic operation of the various cycles in the compaction of the chips and shavings into pellets and removal of cutting fluid therefrom, sensor 134 operates to maintain a level of chips and shavings within bin 62 for a fully automated process. Thus, the operator need only be sure that hopper 120 is maintained with an adequate level of materials for the compactor. It is preferred that the volume of hopper 120 be large enough that attendance to the quantity of material therein need only be occasional.

The present invention thus provides a compactor capable of achieving pressures in excess of 20,000 psi for compacting metal shavings and chips into solid pellets so that the same may be easily transported and recycled. The apparatus additionally recovers cutting fluids and the like from the chips and shavings so that the cutting fluid may be recycled separately. The apparatus is simple and inexpensive, rendering it economically feasible for machine shops to collect, and recover metal pellets from metal chips and shavings as well as to recover cutting fluid.

Although the present invention has been described with reference to preferred embodiments, workers skilled in the art will recognize that changes may be made in form and detail without departing from the spirit and scope of the invention.

What is claimed is:

1. A process for compacting fluid-laden incompressible metal chips and shavings comprising:

introducing the metal chips and shavings to a compaction chamber having an enclosing wall having a first end adjacent which metal pellets are formed from the metal chips and shavings, a piston closing a second end of the chamber opposite the first end, and a barrier adjacent the first end of the chamber movable between a first position blocking the first end to prevent metal pellets in the chamber from being discharged and a second position permitting metal pellets to be discharged, the barrier being so disposed and arranged with respect to the enclosing wall of the chamber to permit fluid to be expelled from the chamber between the barrier and the enclosing wall when the barrier is in its first position;

operating the barrier to its first position;

operating the piston at low pressure to move to a first position in which the piston permits metal chips and shavings to enter the chamber between the piston and the first end;

operating the piston at low pressure to move to a second position to impart a first compacting pressure on metal chips and shavings in the chamber, the first compacting pressure being of such magnitude as to expel fluid from the metal chips and shavings and from the chamber and to form a loosely compacted pellet from the metal chips and shavings in the chamber, the loosely compacted pellet having substantial interstices therein;

operating the piston at high pressure to move to a third position to impart a second compacting pressure on the loosely compacted pellet in the chamber, the second compacting pressure being greater than the first compacting pressure and being of such magnitude as to expel fluid from the loosely compacted pellet and from the chamber to form a compact metal pellet from the loosely compacted pellet substantially devoid of fluid and interstices; and operating the barrier to its second position to discharge the compact metal pellet from the chamber.

2. The process of claim 1 wherein the second compacting pressure is at least 20,000 psi.

3. The process of claim 1 wherein the first compacting pressure is about 12,500 psi.

4. The process of claim 1 wherein the second compacting pressure is between about 25,000 psi and 42,000 psi.

* * * * *

UNITED STATES PATENT AND TRADEMARK OFFICE

CERTIFICATE OF CORRECTION

PATENT NO. : 5,542,348

DATED : AUGUST 6, 1996

INVENTOR(S) : ERVIN J. BENDZICK

It is certified that error appears in the above-indentified patent and that said Letters Patent is hereby corrected as shown below:

Col. 1, line 16, delete "pans", insert --parts--

Col. 1, line 47, delete "meal", insert --metal--

Col. 1, line 51, delete "meal", insert --metal--

Col. 1, line 58, delete "meal", insert --metal--

Col. 2, line 3, delete "meal", insert --metal--

Col. 3, line 54, delete "pans", insert --parts--

Signed and Sealed this

Seventh Day of January, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,542,348

DATED : AUGUST 6, 1996

INVENTOR(S) : ERVIN J. BENDZICK

It is certified that error appears in the above-indentified patent and that said Letters Patent is hereby corrected as shown below:

Col. 1, line 16, delete "pans", insert --parts--

Col. 1, line 47, delete "meal", insert --metal--

Col. 1, line 51, delete "meal", insert --metal--

Col. 1, line 58, delete "meal", insert --metal--

Col. 2, line 3, delete "meal", insert --metal--

Col. 3, line 54, delete "pans", insert --parts--

Col. 6, line 52, after "where", delete "$P_2$" insert --$p_2$

This certificate supersedes Certificate of Correction issued January 7, 1997.

Signed and Sealed this

Fourth Day of March, 1997

*Attest:*

Bruce Lehman

BRUCE LEHMAN

*Attesting Officer*

*Commissioner of Patents and Trademarks*